United States Patent [19]

Tyndall

[11] 4,402,538

[45] Sep. 6, 1983

[54] ASH SHOVEL

[76] Inventor: Louie L. Tyndall, 801 W. 9th St., Ayden, N.C. 28513

[21] Appl. No.: 312,204

[22] Filed: Oct. 19, 1981

[51] Int. Cl.[3] ..... A47F 13/08

[52] U.S. Cl. ..... 294/55; 294/9; 15/257.6

[58] Field of Search ..... 294/9, 50.9, 55, 53.5, 294/49, 50.8, 73; 15/257.1, 257.2, 257.5, 257.6

[56] References Cited

U.S. PATENT DOCUMENTS 3,517,948 6/1970 Miller ..... 294/55

4,299,419 11/1981 Kalan ..... 294/9

FOREIGN PATENT DOCUMENTS 982818 6/1951 France ..... 15/257.6

*Primary Examiner*—James B. Marbert

*Attorney, Agent, or Firm*—Charles R. Rhodes; Judith G. Smith

[57] ABSTRACT

A shovel for removing ashes from the ashpit of a wood stove has a scoop portion and a hinged lid thereon. The scoop portion has bottom wall with upturned lip, side and rear walls and an open front. The lid portion has a downwardly depending extension for overlying the open front of the scoop when the lid is in its closed position. A pair of shortened, horizontally spaced handles are attached to the outer surface of the rear wall. Additionally, an auxiliary handle may be provided for use when carrying the shovel from one place to another. The auxiliary handle is flexible and falls clear of the open lid when released and the shovel is inserted into a stove. Lid control means, in a preferred embodiment, is an elongated tab attached to and extending rearwardly from the edge of the lid, at a midpoint between the handles.

3 Claims, 2 Drawing Figures

ASH SHOVEL

BACKGROUND AND SUMMARY OF THE PRESENT INVENTION

Because of the current energy crisis and increased fuel costs, many people are returning to the use of woodburning stoves and/or fireplaces to heat their homes. Many varieties of wood stoves and freestanding fireplaces are now available in the marketplace. Concurrently with the increased use of such stoves has come an increase in the number and types of accessories for use with them. There are numerous types of lighters, wood storage equipment, cleaning equipment and the like now available. Ash removal equipment is, however, limited to long existing and well-known types of shovels, scoops, etc., for use in removing ashes from the firepits of the stoves or fireplaces.

A review of the prior art directed to ash shovels reveals U.S. Patent to Peebles U.S. Pat. No. 1,762,347, which is an ash shovel that includes a scoop and a hinged lid thereon. There is an elongated handle having a lidoperating rod 15 extending therealong and terminating at a control handle 16. While this shovel is disclosed for use in removing ahses from firepits of stoves or fireplaces, there are several disadvantages making it unsatisfactory in use. These disadvantages include (1) the elongated handle; (2) the awkwardness of the control handle; (3) the sharply inclined sidewalls; (4) lack of an auxiliary handle for carrying in the closed position; and (5) sharp front edge which can snag on fire brick.

Looking at the first two disadvantages, it can be seen that to control the shovel requires that both hands be securely on the elongated handle. However, one hand must be available to grasp the handle on the lid control rod. The simultaneous control of both the shovel handle and the lid control is quite awkward at best. With regard to the sharp decline or slope of the sidewalls, this factor is seen to affect the capacity of the shovel in that most of the ashes must be retained toward the back of the shovel. Although the lid includes deeper sidewalls in FIGS. 3 and 4, many ashes will fall off the forward end of the scoop before the lid can be closed.

The present invention is directed to an ash shovel having a scoop portion of improved depth, a hinged lid, bilateral rear handles and cooperative lid control means, beveled front end of the bottom wall and a flexible auxilary handle for carrying the shovel while closed from one place to another. The improved ash shovel includes sidewalls of a depth to maximize capacity, and it is of an overall width approximately equal to that of the inside dimensions of the firepit opening.

Constructed of a sheet metal material, the shovel includes a scoop portion having rear and sidewalls of substantially equal depth, and an open front and top. A lid is hingedly connected to the rear wall and overlies the top and front of the scoop when in a closed position.

A pair of shortened, horizontally spaced handles are attached to the outer surface of the rear wall. Lid control means, in a preferred embodiment is an elongated tab attached to and extending rearwardly from the edge of the lid at a midpoint between the handles. In an alternative embodiment the tabs are spaced slightly inwardly from and above the aforementioned handles. Either tab arrangement is such that the handles may be gripped by the fingers and the tabs simultaneously depressed by the thumb or thumbs.

The optional, but desired auxiliary handle which is used in carrying the ash shovel from one place to another, includes a flexible chain or cable extending from both sides and at spaced points on the rear wall of the shovel for grasping and carrying from above the shovel.

During use in gathering ashes the ash shovel is gripped by the bilateral handle means with the thumb or thumbs being used to depress the lid control tab or tabs to raise the lid. During this time the flexible auxiliary handle is released and essentially out of the way. The shovel is then pushed into the ashes in the firepit. The beveled front end facilitates movement of the bottom wall across the floor of the firebox. The lid control is released to close the lid and the shovel full of ashes is removed for dumping without spreading smoke or dust. Preferably, but not necessarily, the width of the shovel is substantially equal to the inner dimensions of the firepit. Such width coupled with the uniform depth of the sidewalls allows the cleaning operation to be performed in one exercise. There is no necessity to return the shovel to the firepit to clean along the sidewalls thereof.

Therefore, the objects of the present invention include the provision of an improved ash shovel as described above and which overcomes the major disadvantages of prior art devices. Other advantages of the present invention will become apparent to those skilled in the art as the following detailed description is studied in conjunction with the accompanying drawings.

DETAILED DESCRIPTION OF A PREFERRED EMBODIMENT

Figure 1:
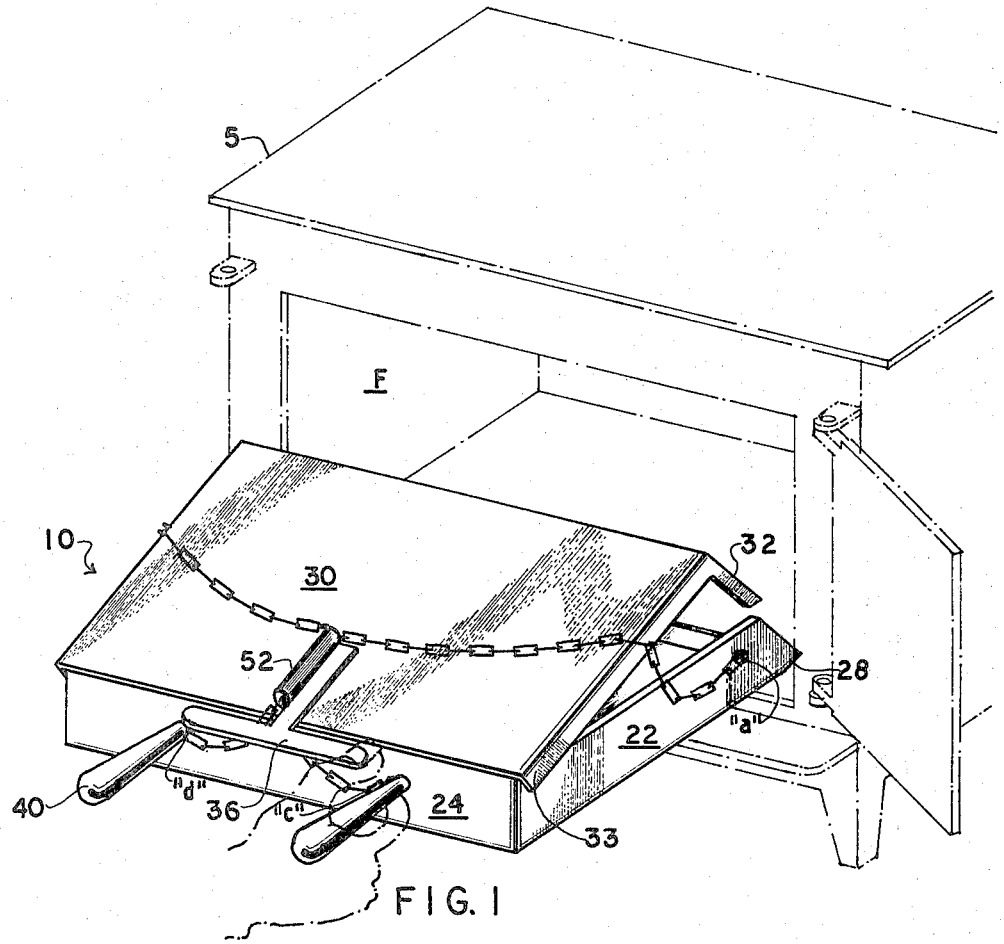
FIG. 1 is an environmental perspective view of a preferred embodiment the invention with the lid raised used in removing ashes from a wood stove.

Looking first at FIG. 1, the ash shovel 10 is shown being used in the process of removing ashes from the firepit F of a wood stove 5. Generally the shovel 10 includes a scoop portion 20, a hinged lid 30 and bilateral handles 40. As illustrated and preferred, the shovel 10 has overall width dimensions approximately equal to those of standard firepit openings, which may vary somewhat from stove to stove. This allows for removal of the ashes in substantially one shoveling movement because the shovel will substantially span the distance between the sidewalls of the firepit. Any ashes left between the outer sidewalls of the scoop and the inner sidewalls of the firepit will merely become a part of the residue which is desirably left in the stove. Obviously, the dimensions may be and are varied to utilize with different sizes of stoves or fireplaces, and may even be smaller than the width of the firepit. However, if the shovel is significantly smaller than the firepit it will be necessary to insert it into the stove a second and third time to adequately remove the ashes.

Figure 2:
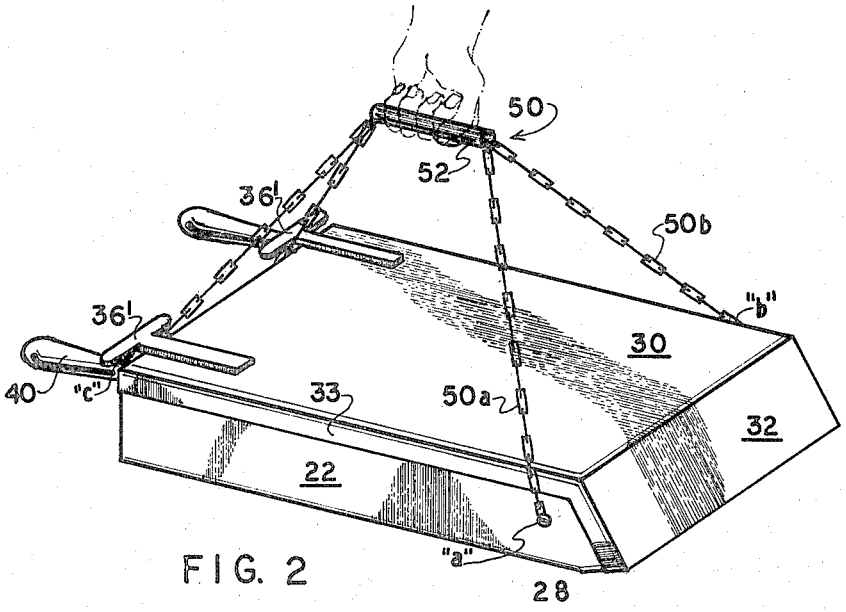
FIG. 2 is a perspective view of an alternate preferred embodiment of the present invention with the lid open and auxiliary handle extended as when being carried from place to place.

Turning to a more detailed view of the shovel, FIG. 2 illustrates an alternate preferred embodiment of the lid control means. As shown in FIG. 2, the scoop portion includes sidewalls 22, a rearwall 24, a bottom wall 26 beveled at the front end thereof to form an upturned lip 28. The lip is angled upwardly at approximately 20° to facilitate movement along the floor of the firebox and to prevent the shovel from snagging or catching on the fire brick of the stove.

The lid 30 includes an extension 32 which depends downwardly and forwardly from the lid 30 to overlie the open front of the scoop portion. Hinges (not shown) connect the lid to the rear wall 24 of the scoop portion 20 and the lid 30 is pivotal thereon from a first closed position to a second, open position.

To operate the lid of the shovel shown in FIG. 1, a single tab 36 extends rearwardly from the edge of the lid just above, and spaced midway between, the horizontally spaced handles 40 which extend rearwardly from rear wall 24. The handles and the tab are arranged such that the operator can grasp both handles at one time and operate the tab with either thumb.

To operate the lid shown in alternate embodiment FIG. 2, a pair of horizontally spaced tabs 36' extend rearwardly from the edge of the lid just above and slightly inwardly of a pair of relatively short, horizontally spaced handles 40 which extend rearwardly of rear wall 24. The handles 40 and the tabs 36' are arranged as previously described to provide easy use and control of the shovel. The handles 40, which are horizontally spaced are grasped by the hands of the operator, while the tabs 36' may be simultaneously depressed by the thumbs to open the lid.

Construction of the shovel 10 would preferably be from a sheet metal material selected from those known to be rigid, durable and realtively lightweight. Conventional metal bending and/or welding operations may be utilized to form the elements of the scoop and lid portions. The tabs may be of the same sheet metal material and formed integrally with the lid or formed separately and attached thereto with screws or rivets. The handles 40 may be formed of wood or some of the heat resistant plastics. The handles are preferred to be rounded for comfort.

For carrying the shovel from one place to another, particularly after it has been filled with ashes, an auxiliary, flexible handle 50 is provided. The flexibility of the handle 50 is preferably achieved by making the handle out of a relatively small gauge metal chain. The chains are attached to the shovel at points "a" and "b" on either side and at points "c" and "d" at the rear. When the shovel is being used to scoop up ashes as shown in FIG. 1, the chain handle falls aside so that the cover 30 can be opened. For carrying as shown in FIG. 2, a gripping means 52 is attached to the handle 50. The gripping means 52 is comprised of a length of metal tubing, of a diameter sufficient to fit loosely around both chains **50*a* and 50*b*, such that it will slide back and forth as necessary with the collapsed handle as seen in FIG. 1. The respective positions of points "a", "b", "c" and "d" are selected so that when the handle is gripped above the shovel as seen in FIG. 2, the chains 50*a* and 50*b* are pulled tightly against the side edges 33** of the cover and help hold it down to prevent spilling of the ashes.

While preferred embodiments have been shown and described herein, it is obvious that other and further modifications, such as elimination of the auxiliary handle 50, may be made without departing from the scope of the claims below.

What is claimed is:

1. A shovel for removal of ashes from the firebox of a wood stove or fireplace comprising:

(a) a scoop portion having bottom, side, and rear walls and an open front;

(b) a lid having the rear edge hingedly connected to said rear wall of said scoop portion and having a downwardly depending extension at one end thereof, said lid further including tab means for pivotally activating said lid from a first closed position to a second, open position;

(c) a pair of relatively short, horizontally spaced handles attached to and extending rearwardly from said rear wall of said scoop;

(d) said tab means for pivoting said lid comprising at least one tab extending rearwardly beyond said lid, said tab being positioned slightly inwardly from and above said handles such that when said handles are in the operator's hand, either thumb is in easy access to said tab;

(e) a flexible, auxiliary handle means comprising a metal chain attached to at least three spaced points on said shovel, said points including at least one on each side wall and at least one on said rear wall, and a grouping means associated with said chain for gripping and carrying said shovel.

2. An ash shovel according to claim 1 wherein said means for pivoting said lid includes a pair of horizontally spaced tabs extending rearwardly beyond said lid, each one of said tabs being positioned slightly inwardly from and above one of said handles such that when said handles are in the operator's hands, the thumbs are in easy access of the tabs.

3. An ash shovel according to claim 1 and further including an upwardly beveled front end on said bottom wall facilitating collection of ashes from the firebox.

* * * * *